United States Patent [19]

Davis, II et al.

[11] 4,049,473

[45] Sept. 20, 1977

[54] METHODS FOR CARBURIZING STEEL PARTS

[75] Inventors: Raymond L. Davis, II, Newtown Square, Pa.; Robert I. Beck, Somerset, N.J.

[73] Assignee: Airco, Inc., Montvale, N.J.

[21] Appl. No.: 665,844

[22] Filed: Mar. 11, 1976

[51] Int. Cl.[2] ..... C21D 1/48

[52] U.S. Cl. ..... 148/16.5; 148/16.6; 148/20.3; 148/155

[58] Field of Search ..... 148/16.5, 16.6, 16, 148/155, 20.3; 266/251, 252

[56] References Cited

U.S. PATENT DOCUMENTS

| | | | |
|---|---|---|---|
| 2,975,083 | 3/1961 | Engelhard | 148/16.5 |
| 3,058,815 | 10/1962 | Davis | 148/16.5 |
| 3,413,161 | 11/1968 | Goehring | 148/16.5 |
| 3,662,996 | 5/1972 | Schwalm et al. | 148/16.5 |
| 3,705,058 | 12/1972 | Kolozsvari | 148/16.6 |
| 3,891,473 | 6/1975 | Latva | 148/16.5 |

*Primary Examiner*—Walter R. Satterfield
*Attorney, Agent, or Firm*—David L. Rae; Larry R. Cassett; Edmund W. Bopp

[57] ABSTRACT

The present invention relates to a method of carburizing and carbonitriding steel parts in the work chamber of a vestibule furnace with a substantially reduced consumption of carbon sources by exposing such parts to a gaseous carbon source such as natural gas while supplying an inert gas to the vestibule at a sufficient rate to control the entry of atmospheric decarburizing agents into the work chamber and to maintain the oxygen content in the vestibule at safe levels, below a minimum level required for supporting combustion or for allowing local puffs and explosions. The vestibule furnace may be of the batch or continuous type. In addition, the carbon potential of the atmosphere within the work chamber of the furnace is preferably continuously sensed and in response to such sensed carbon potential, the flow of natural gas to the work chamber is controlled so as to maintain the carbon potential at a predetermined value.

14 Claims, 5 Drawing Figures

METHODS FOR CARBURIZING STEEL PARTS

BACKGROUND OF THE INVENTION

The present invention relates to methods for heat treating metal parts or workpieces and more particularly, to the carburizing and carbonitriding of steel parts in vestibule furnaces.

The carburization of steel parts is a well known process wherein a "case" is imparted at and below the part surface for the purpose of substantially increasing the carbon content so that such parts may be hardened upon quenching. Typically, steel parts are carburized in a vestibule furnace which is essentially comprised of at least two chambers. An outer chamber which is generally referred to as the furnace vestibule is provided to enable atmosphere coverage of the quench which may be an atmosphere and/or an oil quench. Depending upon the particular furnace construction utilized, workpieces may be charged directly into a work chamber and then removed into a vestibule for a subsequent atmosphere or oil quench. Alternately, workpieces may be loaded in a vestibule, passed to the work chamber and then returned to the same vestibule for quenching. In a continuous furnace inlet and outlet vestibules are provided before and after a hot and/or work zones.

Upon the introduction of an appropriate carrier gas, typically an endothermic or purified exothermic gas, which may be enriched with a quantity of natural gas, a door to the work chamber is opened and the metal parts to be carburized are then transferred to the work chamber which has been previously brought to the necessary temperature. In typical carburizing processes, endothermic gas which is essentially comprised of 40% nitrogen, 40% hydrogen and 20% carbon monoxide with minor or trace amounts of carbon dioxide and water vapor, is supplied to the work chamber and vestibule at a flow rate sufficient to continuously sweep these chambers and substantially prevent the introduction of atmospheric oxygen into the vestibule. In order to assure that a sufficient quantity of a carbon source is present within the atmosphere of the work chamber, the endothermic gas is enriched with a flow of natural gas. It has been found, however, that in order to adequately carburize steel parts in such a vestibule furnace, substantial amounts of natural gas are consumed as the generation and use of endothermic gas in a carburizing furnace requires natural gas or other hydrocarbon source such as propane. Thus, for each 100 cu.ft. of endothermic gas, approximately 45–50 cu.ft. of natural gas are consumed in producing "endo" gas and when enriching natural gas is utilized, as much as 10–20 cu.ft. of additional natural gas are required for each 100 cu.ft. of endothermic gas. Therefore, it is clear that a relatively high and virtually unavoidable consumption of natural gas inherently occurs in the course of conventionally carburizing steel parts in vestibule furnaces.

One rather plain consequence of the steadily increasing demand for hydrocarbon fuels has been reflected as a severe and even critical shortage of natural gas. Presently, numerous industrial users of natural gas are facing sharp curtailment in the quantities supplied if not outright interruption of natural gas flows. Accordingly, many industrial users of natural gas such as heat treating plants in general and steel carburizing facilities in particular, are of necessity forced to substantially reduce natural gas consumption. Accordingly, it is an imperative for those heat treating facilities with vestibule furnaces that substantial reductions in natural gas consumption must be achieved to enable continued carburization of steel parts. Additionally, alternative carburizing techniques must result in the adequate carburization of steel parts at a cost which is economically comparable to the present cost of carburizing steel parts by the aforedescribed process relying upon endothermic and natural gas in order to assure that the metallurgical benefits resulting from carburization in general are commercially justifiable.

In addition to carburizing steel in vestibule furnaces, it is known to conduct this process in a furnace type which is not provided with separate inlet/outlet and work treating zones. Such a furnace is normally referred to as a "pit" furnace and with the addition of appropriate auxiliary equipment such as conduits, filters, meters, and compressors or the like, a furnace atmosphere may be removed from the pit furnace and recirculated in combination with a reduced flow of a carburizing source such as natural gas with an overall reduction of natural gas being obtained in comparison with a similar furnace utilizing a carrier gas such as endothermic gas described above. Such a pit furnace is illustrated in Davis II, U.S. Pat. No. 3,397,875 and although reductions of the consumption of carburizing materials can be realized, integral quenching of carburized steel parts is incompatible with pit furnaces.

As mentioned previously, conventional carburizing processes conducted within vestibule furnaces rely upon a flow of endothermic gas to the work chamber to control the flow of decarburizing agents such as atmospheric oxygen, etc., into this chamber as well as to provide an adequate purge of the furnace vestibule to maintain the oxygen concentration therein below the lower combustible limit. In addition, the amount of natural gas supplied to the work chamber (in addition to the natural gas required for generation and combustion of the endothermic gas) must be sufficient to overcome the decarburizing effect of any contaminants such as oxygen, water vapor $CO_2$ or the like which either leak into, or are generated by reactions within the work chamber as well as those which are contained in the carrier gas and, obviously, to satisfy the carbon demand of the work load. In certain heat treating processes, such as described in U.S. Pat. No. 3,467,366 an inert gas such as nitrogen is supplied to the vestibule of a furnace to enable isolation of the work chamber from atmosphere. However, neither in this prior art nor in other industrial carburizing processes presently known, is there any recognition of the advantages to be obtained from supplying such inert gas to a vestibule and essentially only a gaseous carbon source to a work chamber which may have been purged of deleterious gases during a heat-up period as will now be described in accordance with the present invention.

OBJECTS OF THE INVENTION

It is an object of the present invention to provide improved methods for carburizing steel parts in a vestibule furnace.

It is another object of the present invention to effect carburization of steel parts with substantially lower consumptions of gaseous carbon sources than heretofore possible in vestibule furnaces.

It is still another object of the present invention to provide improved methods of carburizing steel parts by avoiding the requirement of a carrier gas for a gaseous carbon source with a concomitant reduction in the consumption of this carbon source thereby accruing.

It is a further object of the present invention to provide improved methods of carburizing steel parts by introducing an inert gas into the vestibule of a furnace to isolate the work chamber from atmosphere and thereby substantially preclude or control introduction of decarburizing agents into the work chamber such that additional supplies of a gaseous carbon source are not required to overcome the decarburizing effects of such agents.

It is yet another object of the present invention to provide improved methods for carburizing steel parts with reduced consumptions of a gaseous carbon source by increasing the dwell time of such source within a work chamber.

It is still a further object of the present invention to enable the safe carburization of steel parts by assuring that oxygen concentration within the vestibule is maintained below levels capable of supporting combustion.

It is another object of the present invention to control the flow of a gaseous carbon source to the work chamber of a vestibule furnace during carburization of steel parts such that a desired, predetermined carbon potential is maintained in the work chamber atmosphere and the introduction of, and consumption of, excessive amounts of the gaseous carbon source is averted.

It is yet a further object of the present invention to carbonitride steel parts in a vestibule furnace with substantially lower consumptions of natural gas and ammonia than heretofore possible.

Other objects of the present invention will become apparent from the detailed description of an exemplary embodiment thereof which follows and the novel features of the present invention will be particularly pointed out in conjunction with the claims appended hereto.

SUMMARY

The present invention relates to methods for carburizing steel parts wherein the conventional approach of utilizing an endothermic gas as a carrier for an enriching flow of natural gas, propane, etc. and apparatus for generating this carrier gas, are discarded. Furthermore, the method according to the present invention involves the incorporation of two essentially unrelated concepts which are not now, nor have ever been, considered for use in combination with conventional carburizing/carbonitriding processes utilizing an endothermic carrier gas as mentioned above. Thus, the present invention, in its broadest aspects, relates to the carburization or carbonitriding of steel parts in a vestibule furnace wherein an inert gas is introduced into the furnace vestibule at the minimum flow rate necessary to isolate the work chamber from ambient atmosphere and/or prevent oxygen build-up or pocketing within the vestibule to levels allowing combustion or explosion, while a gaseous carbon source, at relatively low flow rates, is supplied to the work chamber. It will be understood that either carburizing or carbonitriding of steel parts may be achieved in accordance with the present invention. However, for purposes of convenience, the term "carburizing" as used hereinafter will be equally applicable to "carbonitriding" steel parts. The inert gas supplied to the vestibule may comprise nitrogen, argon, etc. while the gaseous carbon source may comprise natural gas, methane, propane, coke gas, carbon monoxide, or the like. In addition, it is within the scope of the present invention to supply a liquid hydrocarbon fuel to the work chamber wherein this fuel is vaporized. However, for purposes of convenience, the term "natural gas" will be utilized as the full equivalent of the gaseous carbon sources listed above.

Accordingly, the method according to the present invention enables presently available conventional, imperfect vestibule furnaces to be operated in a manner approaching a gas tight, pit furnace with a relatively slight addition of capital equipment. Consequently, the resource economizing attributes of pit furnace carburization may now be fully realized during carburizing in conventional vestibule furnaces. The discovery which has led to the present invention briefly outlined above, and which has not until now been practiced in any commercial vestibule furnace, enables astounding reductions (up to 95% or more) of previous levels of natural gas consumption for carburizing atmospheres while simultaneously eliminating both a carrier gas and equipment for generating the same and yet adequately carburizing steel parts. The natural gas required for the "carburizing atmospheres" in conventional atmospheres includes a first quantity of natural gas which is partially combusted to produce the "endo" gas. However, as the combustion reaction is "endothermic", more natural gas is required to be burned to develop the temperatures necessary for combusting the first quantity of natural gas. The natural gas enrichment is, of course, additional to the foregoing quantities of natural gas. It should be noted that the natural gas which may be utilized as a fuel gas to develop the necessary temperatures (1350°–1800° F) within the carburizing furnace is exclusive of the natural gas required for the "carburizing atmosphere."

That is, not only is natural gas which is already in critically short supply conserved by the method according to the present invention but adequate carburization of steel parts is achieved without the use of an endothermic carrier gas and its conventional generating equipment. Additionally, as carburization in accordance with the present invention enables significant reductions in natural gas consumption for carburizing atmospheres many heat treating plants will be able to continue carburizing operations notwithstanding sharp cutbacks or curtailments of natural gas supplies due to the present critical shortage of this raw material.

Although the method according to the present invention does require a supply of an inert gas such as nitrogen, which is readily available through conventional air separation techniques, it is believed that the overall cost of carburizing steel parts in conventional vestibule furnaces will be no greater and generally less than comparable costs for carburizing such parts in accordance with prior art processes utilizing an enriched endothermic carrier gas.

In accordance with the present invention, a method of carburizing steel parts in a vestibule furnace comprises the steps of exposing such parts to a gaseous carbon source in a furnace work chamber and introducing a flow of inert gas into the furnace vestibule thereby substantially precluding or controlling the entry of atmospheric decarburizing agents into the work chamber and effecting carburization of steel parts therein without utilization of an endothermic or purified exothermic carrier gas and with substantially reduced consumption of natural gas as compared with the consumption levels of gaseous carbon sources such as natural gas required in carburization processes utilizing said carrier gas.

The method of carburizing steel parts in accordance with the present invention may be practiced in connection with conventional batch or continuous vestibule furnaces. In addition, it is preferred to control the gaseous carbon source flow to the work chamber of the particular vestibule furnace by sensing the carbon potential of the atmosphere within this chamber and controlling the supply of the gaseous carbon source so as to maintain a desired, predetermined carbon potential therein. Inert gas is supplied to the vestibule of the particular furnace continuously during carburization. Furthermore, the inert gas is also supplied to the vestibule before loading thereof with steel parts as well as during a quench or other cooling of such parts after removal from the work chamber.

The flow rate of inert gas to the vestibule is preferably established to be sufficient to remove oxygen and other decarburizing agents therefrom although the optimum flow rate will be set so as to maintain, during quench conditions, an oxygen concentration below the lowest oxygen concentration required for combustion of a particular gaseous carbon source diluted with a particular inert gas at the temperatures and pressures within the vestibule. Thus, by establishing an inert gas or nitrogen flow so as to maintain the foregoing maximum oxygen concentration, the utilization of nitrogen is enhanced while an insufficient concentration of oxygen for supporting combustion within the vestibule and hence safe operating conditions are assured. The flow rate of natural gas to the work chamber is controlled as aforesaid and, by establishing the aforementioned, economized nitrogen flow to the vestibule, a minimum nitrogen back flow to the work chamber will be attained. Thus, the nitrogen introduced into the vestibule will result in a relatively low nitrogen dilution of natural gas in the work chamber and consequently the kinetics of carburizing reactions within the work chamber will not be significantly impaired. This in turn will enable carburization of steel parts with a minimum flow rate of natural gas. Also, by utilizing such a minimal natural gas flow rate to achieve a desired carbon potential and consequently a desired carburization, a greater residence or dwell time of all gas constituents in the work chamber is achieved thereby additionally facilitating gas equilibration which is favorable to the carburizing reactions. Thus, by avoiding a process wherein the carbon source is continually swept out of the work chamber as in the case of prior techniques wherein the carrier gas for the carbon source is swept from the chamber in order to remove decarburizing agents, a greater utilization of the carbon source is attained and consequently, reductions in natural gas consumption of up to 95% or more of those levels previously required for carburizing atmospheres using a carrier gas can be now obtained by utilization of the method according to the present invention. Importantly and in addition, the necessity of using a carrier gas and costly equipment for generating this gas is also obviated by practice of the present invention. Thus, the method according to the present invention remarkably and unexpectedly enables the foregoing reductions in natural gas consumption as well as enabling the continuance of carburizing operations in heat treating plants threatened with substantial curtailment in natural gas supplies.

BRIEF DESCRIPTION OF THE DRAWING

The invention will be more clearly understood by reference to the following detailed description of an exemplary embodiment thereof in conjunction with the following drawing in which.

DESCRIPTION OF PREFERRED EMBODIMENTS

Figure 1:
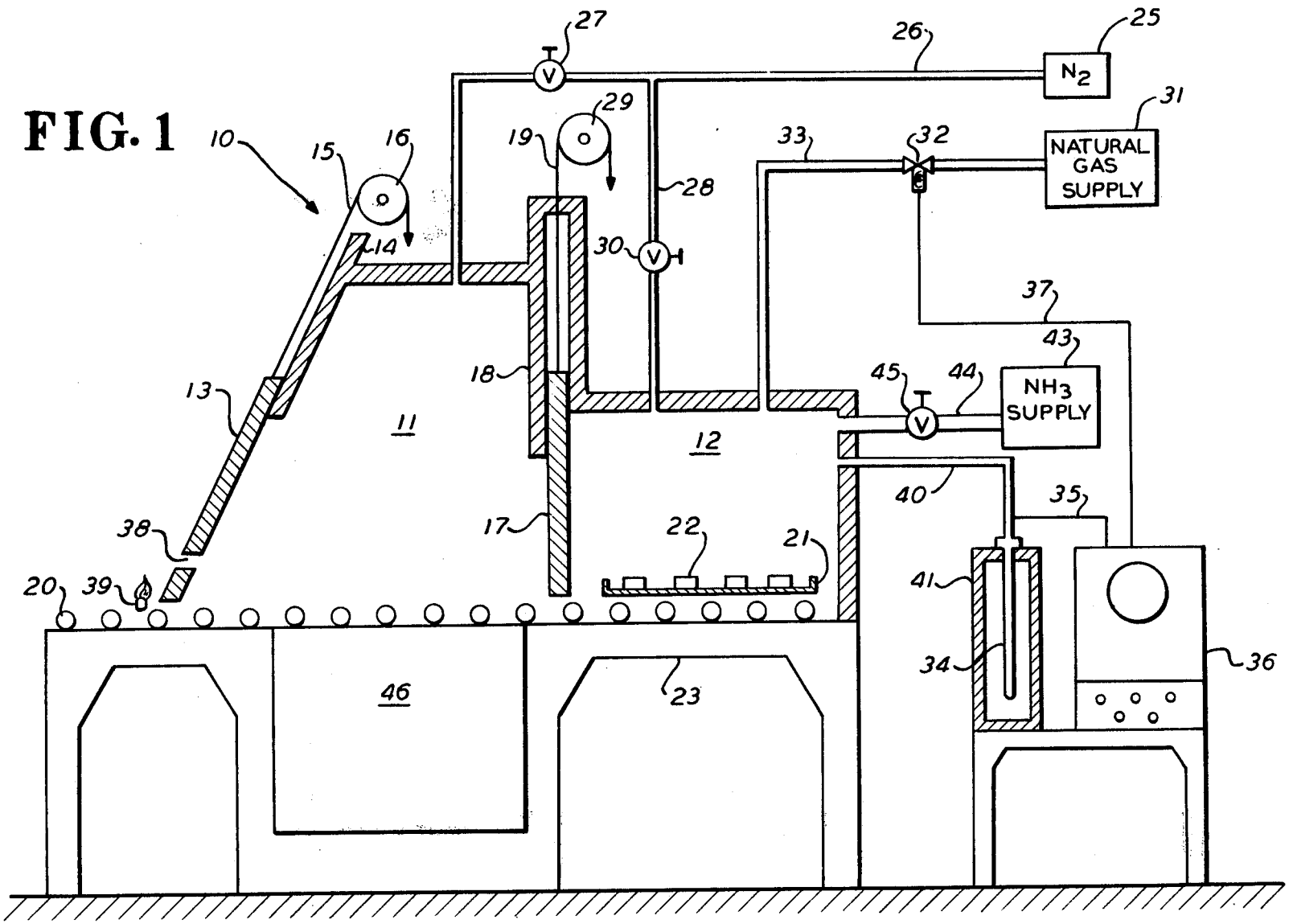
FIG. 1 is a partial elevational and schematic view of a batch type vestibule furnace utilized for carrying out the method according to the present invention.
Figures 2, 3:
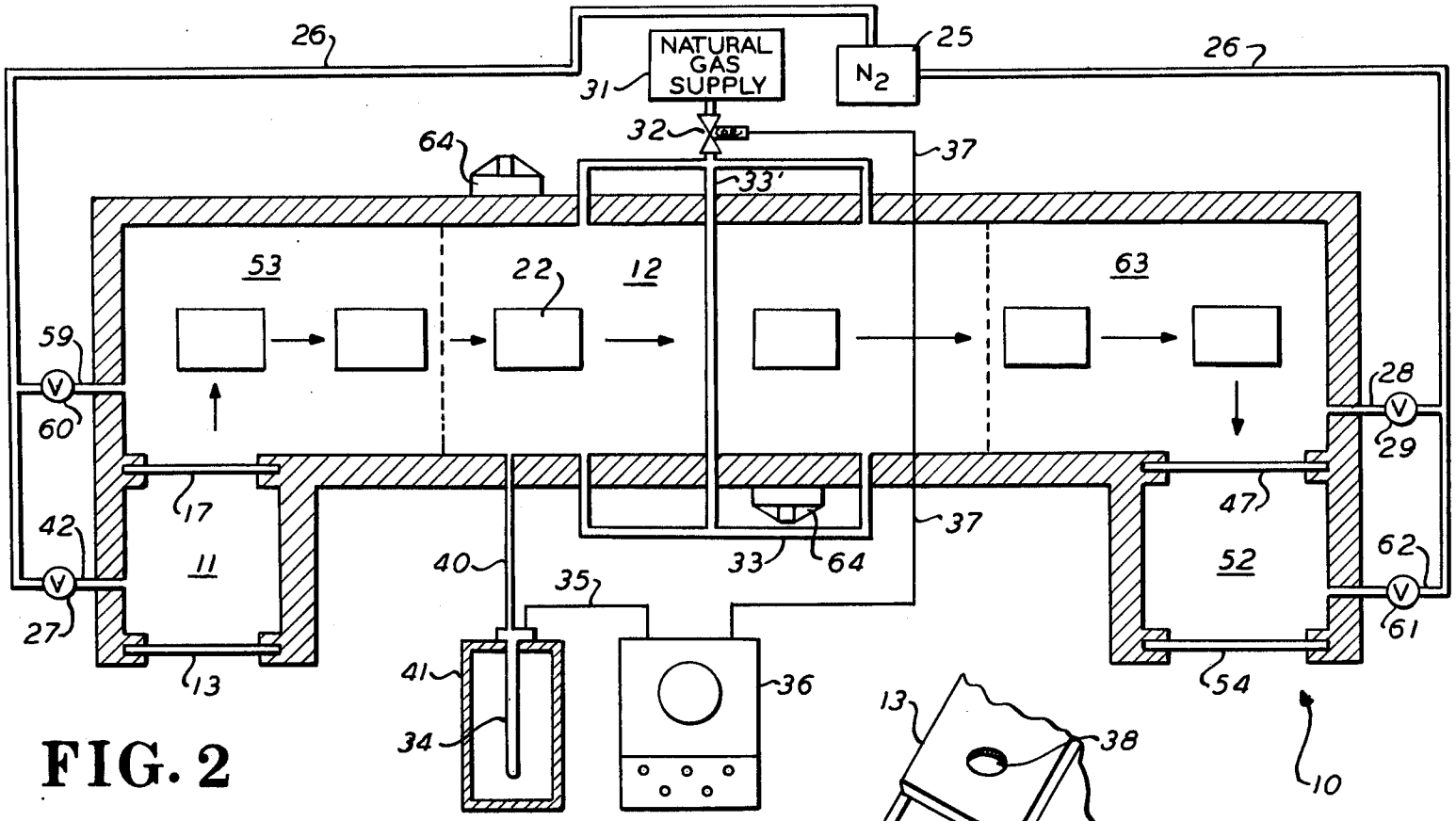
FIG. 2 is a top view of a continuous furnace in which the method according to the present invention may be practiced.
FIG. 3 is a partial isometric view of structure for providing a flame curtain at the entrance of either furnace illustrated in FIG. 1 or 2.

Referring now to FIGS. 1 and 3 of the drawing, illustrated therein is an exemplary embodiment of a batch furnace 10 in which steel parts may be carburized in accordance with the present invention. Furnace 10 includes a vestibule 11 and a work chamber 12 separated by a sliding, inner door 17 which is preferably operated between open and closed positions within a guide or channel 18 by means of cable 19, pulley wheel 29 and a hydraulic activating device (not shown). The entrance to vestibule 11 is defined by door 13 which is likewise disposed to slide along an inclined plane defined by guide 14 and an exterior surface of furnace 10. Additionally, door 13 is similarly driven by means of a pulley wheel 16 and cable 15, etc. Although pulley and cable arrangements are illustrated as mechanisms for operating doors 13 and 17, it will be understood that any conventional means for selectively translating such doors between open and closed positions may be utilized. Preferably, door 13 is provided with an aperture 38 adjacent to and exteriorly of which a pilot flame 39 is established for reasons to be subsequently discussed. A suitable conveyor means 20, which may comprise a plurality of driven and idler rollers over which a work tray 21 containing steel workpieces 22 is passed, is provided in known manner. A frame 23 is disposed to support furnace 10 and a quench tank 46 is also conventionally located beneath vestibule 11. As those skilled in the art will appreciate, carburized workpieces 22 removed from work chamber 12 are quenched, generally in an oil bath or by atmosphere, before removal from furnace 10. Suitable means, not shown, for lowering and raising a work tray into and from such a bath and raising the work tray to the upper portion of the vestibule (so it is directly under a circulating fan for atmosphere quench) are also provided.

In order to carburize steel parts in vestibule furnace 10 while reducing consumption of natural gas by up to 95% or more of amounts previously consumed in integral quench, vestibule furnace atmospheres utilizing an endothermic carrier gas, a supply 25 of inert gas such as nitrogen is connected through conduit 26 and valve 27 to vestibule 11 and through conduit 28 and valve 30 to work chamber 12. The flow of nitrogen to vestibule 11 is generally established at less than 50%, and preferably 25–30% of the recommended carrier gas flow to furnace 10. For example, if the carrier gas flow recommended for furnace 10 is 400 ft.$^3$/hr. it is preferred to supply nitrogen at the rate of only 10 ft.$^3$/hr. or less to 150 ft.$^3$/hr. to the vestibule of this batch furnace. Of course, the particular flow rate will be largely determined by the volume of vestibule 11 and the degree to which quenching sucks in atmospheric air, although it has been found by establishing the foregoing nitrogen flow, the average oxygen concentration in vestibule 11 is maintained below the minimum level necessary to support combustion.

The gaseous carbon source which is preferred for carburizing workpieces 22 in accordance with the present invention is natural gas although methane, propane, etc. may be utilized as well. Natural gas may be provided by supply 31 through valve 32 and conduit 33 to work chamber 12. However, it is within the scope of the present invention to provide minor amounts of other, non-decarburizing agents such as raw ammonia, not as a carrier gas, but for carbonitriding workpieces 22. Thus, an ammonia supply 43, conduit 44 and on-off valve 45 are provided to enable $NH_3$ gas to be selectively supplied to work chamber 12. In that the present invention does not require, but rather specifically avoids, an endothermic carrier gas, only a relatively low flow rate of the gaseous carbon source (on the order of 10–40% of the natural gas enrichment flow) is required to adequately carburize steel workpieces 22 in chamber 12. By utilizing such a relatively low flow rate of natural gas, not only is the natural gas previously used for enrichment reduced by up to 90% but endothermic carrier gas (hence considerably more natural gas as mentioned above) and the equipment required to generate this gas may be dispensed with completely. Thus, overall reductions of up to 95% or more of the levels of natural gas previously required for carburizing atmospheres may be obtained by the method and apparatus according to the present invention. In addition, as noted above, those heat treatment plants subjected to sharp curtailment of natural gas supplies will in all likelihood be able to continue carburizing operations by utilizing the improved carburizing method according to the present invention.

In order to enable predetermined case hardening of workpieces 22 to be obtained, the method according to the present invention contemplates controlling the carbon potential of the atmosphere within work chamber 12. To accomplish this objective, a carbon potential sensor or probe 34 is mounted in separate furnace 41, to which work chamber atmosphere sampling conduit 40 is connected. Recorder/controller 36 is connected to probe 34 by cable 35. Preferably, probe 34 comprises a thin wire mounted in the atmosphere of separate furnace 41, the atmosphere of such furnace being representative of the atmosphere in work chamber 12, with the resistivity of such wire varying as a function of the carbon potential of the work chamber atmosphere. This change is resistivity is due to the wire itself carburizing and decarburizing; as a result of the atmosphere's carbon potential being higher or lower than the carbon content of the wire. An electrical signal representative of the carbon potential within work chamber 12 is supplied over cable 35 to recorder/controller 36 which is effective to graphically record the value of such carbon potential as a function of time as well as generate an output signal over cable 37. More particularly, recorder/controller 36 is initially set for the carbon potential desired within work chamber 12. By comparing the signal supplied over cable 35 representative of the actual carbon potential of the atmosphere within work chamber 12 against the desired specified carbon potential, a control signal is generated and supplied over cable 37 to either open or close valve 32 or to provide a continuous adjustment of the opening, and hence, natural gas flow through this valve. Probe 34, separate furnace 41 and recorder/controller 36 are conventional equipment for controlling the carbon potential of a furnace atmosphere and are commercially available from Carbon Control Instruments, Newtown Square, Pa. In addition, it will be understood that probe 34 may be located directly within work chamber 12 although it is preferred to provide this probe in a separate furnace 41 which may be more readily temperature controlled. Conventional circulating fans (not shown) may be provided in the roof or sidewall of work chamber 12 to assist in promoting carburizing reactions therein.

The method according to the present invention and hence, operation of the apparatus illustrated in FIGS. 1 and 3 will now be described. Initially, furnace 10 is brought to a desired temperature by energization of conventional heating elements such as radiant tubes within work chamber 12, and vestibule 11 is purged with nitrogen at, for example, a rate equal to 25–30% of the recommended endothermic carrier gas flow rate. In addition, work chamber 12 may also be purged with nitrogen by opening valve 30 for a desired period of time. Steel workpieces 22 are then loaded in tray 21 on conveyor means 20 outside of furnace 10 and door 13 of vestibule 11 is opened. Opening of this door will then effect a flow of natural gas to burner 51 and consequently, a flame curtain 51' will be ignited at the immediate exterior of furnace 10 as illustrated in FIG. 3. By combusting a fuel immediately adjacent to the inlet of vestibule 11, a reduction in the amount of atmospheric oxygen entering the vestibule will occur and, any oxygen which does pass through flame curtain 51' will be diluted with the nitrogen previously introduced into vestibule 11. Tray 21 is then conveyed into vestibule 11 while inner door 17 remains in a closed position as illustrated in FIG. 1. Outer door 13 is then closed while work tray 21 remains in vestibule 11 until a positive pressure is detected therein. It will be appreciated that a slightly positive pressure is necessary in order to assure that atmospheric contaminants, i.e. decarburizing agents are effectively precluded from entering vestibule 11 and hence work chamber 12 is substantially isolated from ambient atmosphere. The occurrence of such a positive pressure is detected by the action of pilot burner 39 as until this pressure occurs, the flame of this burner will be sucked into aperture 38 in door 13. However, when a positive pressure is reached as a consequence of continuing nitrogen flow through conduit 26 into vestibule 11, the flame of pilot burner 39 will remain exteriorly of outer door 13. After observing the flame in this latter condition for a predetermined period of time for a furnace of a particular size, the oxygen content of vestibule 11 will be below maximum, safe levels. At this point, inner door 17 is opened and the work tray 21 is moved into work chamber 12.

It has been found that upon opening inner door 17 and introducing work tray 21 into work chamber 12, some air is in fact drawn into vestibule 11 and under inner door 17 into work chamber 12 due to the imperfect sealing action of these doors and to the fact that work chamber 12 is relatively gas tight. This lowers the carbon potential of the atmosphere within chamber 12 as, of course, air is comprised of decarburizing agents such as oxygen, $CO_2$ impurities and water vapor. Accordingly, the carbon potential which may exist within chamber 12 decreases. In addition, as probe 34 is calibrated to detect carbon potentials generally at the process or carburizing furnace temperature, and as opening of inner door 17 and entry of cold workpieces 22 and tray 21 causes a reduction in work chamber temperature which slows reaction kinetics and hence the degree to which a given atmosphere will carburize, it will be necessary to await the increase in temperature of chamber 12 to the preferred level for carburizing to become effective. During this temperature recovery period, nitrogen may be supplied through valve 30 to work chamber 12 to purge the same of volatized residual cutting oils or cleansing agents frequently remaining on workpieces in typical heat treating plants. During this purge period, a flow of natural gas is preferably either reduced or shut off as an economy measure. The flow of natural gas from supply 31 through valve 32 and conduit 33 into work chamber 12 is controlled by means of probe 34, located in furnace 41 which is maintained at a constant temperature. The nitrogen purge of work chamber 12 is terminated after a predetermined period of time. Upon reaching the desired furnace temperature, carburization of workpieces 22 will commence at the desired rate and the carbon potential within work chamber 12 will be controlled by means of probe 34 and recorder/controller 36 while the agitation necessary of chamber 12 may be provided by circulating fans (not shown). Typically, the initial flow rate of natural gas to work chamber 12 may be reduced subsequently since later in the cycle less natural gas will be necessary to maintain a predetermined carbon potential (for example 1%) as the gradient between the carbon potential of the atmosphere and carbon content of the case of steel workpieces decreases. Also, by reducing the flow rate of natural gas to chamber 12, the effective residence or dwell time of this carbon source in chamber 12 is increased unlike conventional carburizing processes utilizing an endothermic gas which is swept from a work chamber in order to enter a vestibule. Thus, a highly efficient use of the scarce carbon source, e.g. natural gas, is obtained by practice of the method according to the present invention. In addition, by reducing the flow of nitrogen from supply 25 into vestibule 11 to a value, such as, for example, 25–30% of the recommended carrier gas flow for the particular furnace, which is sufficient to maintain an oxygen concentration therein below levels required to support combustion, the tendency of nitrogen to "back-diffuse" into work chamber is substantially reduced. A consequence of this facet of the present invention is that not only is nitrogen utilized economically, but that nitrogen does not substantially dilute the gaseous carbon source within work chamber 12 and thus the kinetics of the carburizing reactions within chamber 12 are not significantly impaired. Actual test results obtained during carburization and quenching in accordance with the present invention indicate that the process is safe, i.e. free from explosion, with a vestibule nitrogen flow during quench set at 25–30% of the recommended carrier gas flow rate.

Figure 5:
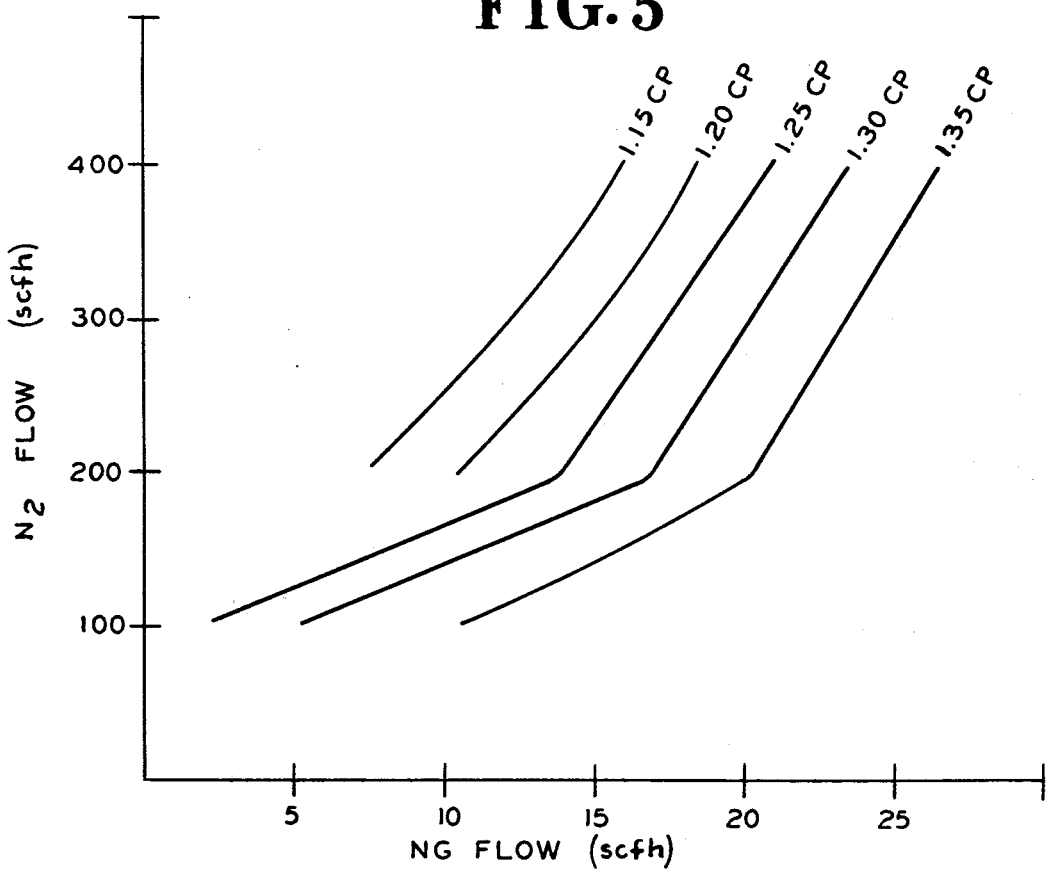
FIG. 5 is a graphical representation of vestibule inert gas flow versus work chamber carbon potential for different flow rates of a gaseous carbon source.

Furthermore, it has been found that not only are reaction kinetics not impaired by nitrogen back diffusion but by reducing nitrogen flow, a still lower gaseous carbon source flow rate is effective to overcome the decarburizing effects of any air leaking into and/or loss of atmosphere from work chamber 12 while yet maintaining a predetermined carbon potential within work chamber 12. This relationship is illustrated in FIG. 5. For example, in order to maintain a carbon potential of 1.30, 21 scfh of natural gas are required when 300 scfh of nitrogen are supplied to the furnace vestibule. However, the same carbon potential will be maintained with a flow of approximately 16.25 scfh of natural gas when a reduced flow of 200 scfh of nitrogen is supplied to the vestibule. Thus, not only does the method according to the present invention effect substantial savings in the amounts of gaseous carbon sources required for carburizing atmospheres by avoiding an endothermic carrier gas and additional natural gas enrichment, but even further reductions in the requirements of a gaseous carbon source can be achieved by reducing the vestibule inert gas flow as mentioned above.

From the foregoing, it will be appreciated that by supplying a gaseous carbon source without a carrier gas to work chamber 12 and nitrogen to vestibule 11, an efficient carburization of workpieces 22 will be effected in a vestibule furnace and reduction in the amounts of natural gas required for the furnace atmosphere on the order of up to 95% or more will be obtained. In addition, neither increased furnace temperatures nor extended carburizing periods are required to achieve desired increases in workpiece carbon content. Thus, the present invention constitutes a significant improvement over those prior art processes utilizing an endothermic carrier gas enriched with natural gas as the method according to the present invention enables the operation of such vestibule furnaces as if these furnaces were in fact highly efficient pit type furnaces.

The carburization of workpieces 22 is then continued for a predetermined period of time such as, for example, 2.0–3.0 hours. Subsequently, door 17 is opened and tray 21 is moved into vestibule 11. Although this operation will result in the flow of some carburizing atmosphere from chamber 12 to vestibule 11, as oxygen within vestibule 11 is highly diluted by the substantially nitrogenous atmosphere therein and as oxygen and combustible atmosphere are not premixed, the absence of any explosion or fire hazard is essentially assured. At this point, tray 21 with workpieces 22 therein may be cooled by lowering the same into a quench tank 40 wherein an oil quenching is effected or elevated to the upper portion of the vestibule for an atmosphere quench. Typically, upon immersing tray 21 and workpieces 22 in an oil bath, a large and violent suction of atmospheric air through or around outer door 13 into vestibule 11 will occur. However, as a consequence of the flow of purge gas such as nitrogen to vestibule 11 during the quenching of carburized workpieces, the amount of oxygen drawn into vestibule 11 nonetheless remains below those levels necessary for supporting combustion. Furthermore, as the aforementioned suction effect occurs after the workpieces enter the oil quench, the admitted oxygen has no adverse effect on the workpiece or on the metallurgical properties of such workpieces. It may, however, be desirable to increase the nitrogen flow to a vestibule during an atmosphere quench or in vestibules of continuous furnaces or other "loose" furnaces which require such an increased $N_2$ flow to preclude the introduction of decarburizing agents, etc., into the furnace work chamber, or the formation of explosive mixtures in the vestibule. Consequently, not only does the method according to the present invention enable a highly efficient (in terms of natural gas consumption) carburization of workpieces but, very importantly, this method does not impair other conventional aspects of a heat treating cycle such as the quenching of treated workpieces.

In addition to enabling carburization of workpieces 22, the method according to the present invention is equally suitable for carbonitriding such workpieces. The latter process is effected in a manner similar to carburization but with the controlled addition of raw ammonia to work chamber 12. In a typical carbonitriding process, nitrogen is introduced into vestibule 11 as previously mentioned and recorder/controller 36 is set to establish a carbon potential of approximately 0.9 within work chamber 12. Upon introduction of a controlled flow of natural gas through valve 32 and conduit 33 into work chamber 12, furnace 10 is permitted to equilibriate at approximately the foregoing carbon potential. Recorder/controller 36 is then set to a carbon potential of approximately 1.2 or so and a controlled flow of raw $NH_3$ is then passed through conduit 44 and valve 45 into work chamber 12. The "carbon" potential (1.2 or so) registered by recorder/controller 36 will then constitute a combination of the carbon and nitriding potential of the atmosphere within work chamber 12 as probe 34 will also undergo a change in resistivity in response to detecting a nitriding atmosphere in a manner similar to the detection of a carbon potential as described earlier. In this manner, a nitriding potential equivalent to 0.3–0.5% carbon may readily be established within work chamber 12 and by exposing workpieces 22 to such an atmosphere for periods between 30 minutes and several hours and at temperatures between 1350°–1650° F, a carbonitriding of such workpieces will be achieved. The carbonitriding of workpieces in accordance with the present invention will also result in reductions of natural gas consumption up to 95% for furnace atmospheres. Additionally, it has been found that consumption of raw ammonia may also be reduced by 50–70% over amounts required by prior techniques while yet obtaining requisite degrees of carbonitriding.

Referring now to FIG. 2, illustrated therein is an examplary embodiment of a continuous type vestibule furnace generally comprised of the following sections; vestibule 11, preheat zone 53, work zone 12, partial cooling zone 63, and outlet vestibule 52. In order to avoid unnecessary duplication, only that structure which is distinct from structure previously described in connection with the batch type furnace illustrated in FIG. 1 will now be described. Nitrogen supply 25 is coupled through conduits 26 and 42 as well as valve 27 to selectively supply nitrogen to vestibule 11. In addition, conduit 59 and valve 60 are likewise provided to enable the supply of nitrogen to preheat zone 53 while conduit 28 and valve 29 are provided to selectively enable nitrogen to be supplied to partial cooling zone 63 as heretofore described. In addition, valve 61 is coupled to conduit 62 such that nitrogen may be supplied to vestibule 52 during operation of the continuous furnace 10' illustrated in FIG. 2. In addition to doors 13 and 17, and means for driving the same, a plurality of doors 47 and 54 are also provided in known manner. Typically, work zone 12 is heated by elements while preheat and partial cooling zones 53 and 63, respectively, are heated by convection due to the heat generated in work zone 17. Appropriate circulating fans 64 are preferably provided with continuous furnace 10' in known manner.

The operation of continuous furnace 10' in accordance with the teachings of the present invention will now be briefly described. Initially, work zone 12 is brought to a desired temperature of, for example, 1750° F and a suitable nitrogen flow is supplied to vestibule 11, and vestibule 52. Upon detecting a positive pressure in, for example, vestibule 11, door 13 is opened and workpieces to be carburized may be translated therein. Similarly, door 17 is opened and these items may then be passed through preheat zone 53 wherein the workpieces are heated. Consequently, opening of doors 13, 17, 47 and 54 is effected to the extent necessary to enable such workpieces to pass continuously thereunder. In addition, as a flow of nitrogen into vestibules 11 and 52 is effective to establish a slightly positive pressure therein, the danger of decarburizing agents contained in the ambient atmosphere from entering work zone 12 through the vestibules is significantly reduced. Thus, workpieces 22 are passed from preheat zone 53 into work zone 12 wherein the same are carburized as previously described. In addition, by sensing the carbon potential of the work chamber atmosphere established by virtue of the natural gas flow through valve 32 and conduit 33 into zone 12, the carbon potential can be accurately maintained such that a desired carburization of workpieces 22 is attained. Consequently, probe 34 located in separate constant temperature furnace 41, the atmosphere of which is supplied through sampling conduit 40 from work zone 12 and recorder/controller 36 and valve 32 operate in connection with continuous furnace 10' in the same manner as this structure is operated in connection with the batch furnace 10 illustrated in FIG. 1.

Upon carburization of workpieces 22 in work chamber 12, such pieces are passed into partial cooling zone 63 and subsequently passed into vestibule 52 wherein, preferably, workpieces 22 are subjected to a quench which may take the form of an oil bath or atmosphere quench. Finally, upon removal of such workpieces from the quench, fully heat treated workpieces 22 are then removed from furnace 10' in a continuous fashion. It may, of course, be necessary to supply nitrogen through conduit 62 and valve 61 at a slightly greater rate than is supplied to vestibule 11 in order to assure that the suction of ambient air caused by the rapid quenching of carburized workpieces does not result in oxygen concentrations within vestibule 52 greater than a level which is required for sustaining combustion, e.g. 5% or less.

The method of carburizing workpieces according to the present invention has been successfully practiced in the course of experiments conducted with an integral quench, batch furnace manufactured by Lindberg Engineering Co., Chicago, Ill. This furnace is similar to furnace 10 illustrated in FIG. 1. In order to demonstrate that reductions of up to 95% or more of natural gas required for atmospheres during carburization can be achieved, two production runs were conducted. In each of runs A and B, work loads of approximately 100 lbs. of steel bars and 1020 and 8620 alloy steel test pieces were carburized at 1750° F for five hours in an atmosphere having a carbon potential of 1.28.

RUN A

A flow of endothermic gas (40% $N_2$, 40% $H_2$, 20% CO) was supplied to the furnace work chamber at 400 scfh (the recommended flow rate for this furnace) together with a natural gas enriching flow of an average of 13 scfh which was required to maintain a carbon potential of 1.28. This is in accordance with prior art carburizing techniques. The Knoop hardness was measured at various depths from the test workpiece surface and the hardness/depth relationship observed is also plotted in FIG. 4 as curve A. An effective case depth (at 540 Knoop hardness) of approximately 0.066 was obtained.

RUN B

Figure 4:
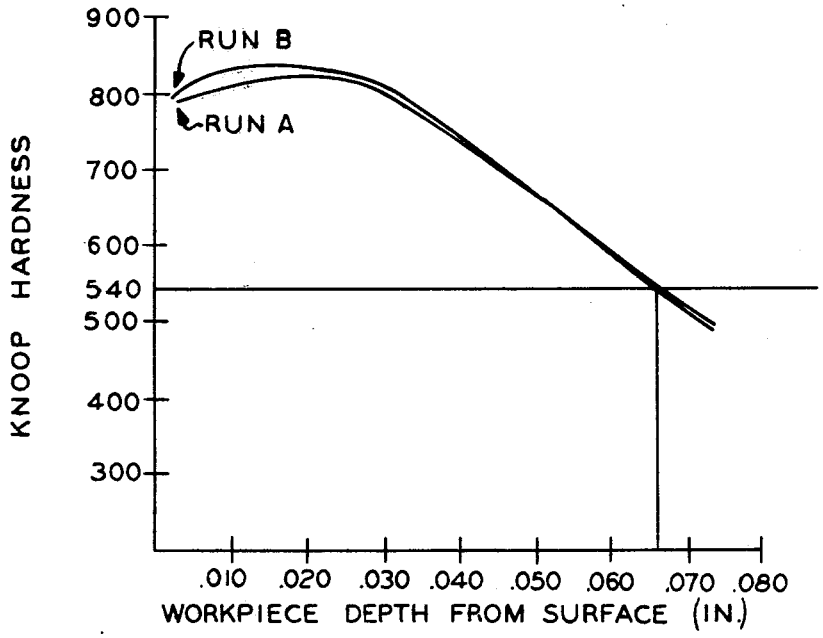
FIG. 4 is a graphical representation of hardness versus depth from the workpiece surface of pieces carburized by the method according to the present invention and by a conventional technique.

In this run, 100 scfh of nitrogen gas was supplied to the furnace vestibule and an average of 2.5 scfh of natural gas was introduced into the work chamber in order to maintain the foregoing carbon potential. The Knoop hardness of the carburized test pieces was measured by conventional techniques and is illustrated as curve B in FIG. 4. As those skilled in the art will appreciate, a Knoop hardness of 540 corresponds to a carbon content of 0.4% and the depth from the work-piece surface at which this hardness level occurs defines the "effective case depth" of the carburized workpiece. As depicted in FIG. 4, the effective case depth of test pieces carburized in accordance with the present invention is approximately 0.066 inch.

The aforementioned experiments designated as Runs A and B indicate that comparable case hardening of test steel workpieces has been obtained. However, the method according to the present invention (Run B) utilized less natural gas than would be expected from merely eliminating an endothermic carrier gas as a consequence of reduced vestibule nitrogen flow resulting in lower pressure in the work chamber and less atmosphere loss. The production and combustion of 400 scfh of "endo" gas required approximately 225 scfh of natural gas plus a spike of 13 scfh or a total of 238 scfh. In contradistinction to this relatively large consumption of natural gas, the method according to the present invention required only a total of 2.5 scfh, or approximately a 99% reduction in the natural gas required for the carburizing atmospheres. In view of current prices for nitrogen and natural gas, the method according to the invention is additionally more economic than prior art methods utilizing an endothermic carrier gas.

In summary, it will be appreciated that the method of carburizing workpieces in a vestibule furnace in accordance with the present invention results in a highly beneficial exploitation of vestibule furnaces in a manner not heretofore recognized or practiced by the heat treating industry. In addition, by discarding conventional carburizing techniques utilized for decades with vestibule furnaces (employing an endothermic carrier gas for the carbon source) and by relying upon the teachings of the present invention, certain highly desirable attributes of pit furnaces can be effectively and simply imparted to vestibule furnaces. Thus, the ability of reducing gaseous carbon source flows, previously realized with pit furnaces can now be exploited in vestibule furnaces and by the controlled nitrogen flooding of vestibules as taught by the present invention, safe operation conditions, the necessary isolation of the work chamber from atmosphere, and hence integrity of the carburizing process are maintained. Furthermore, by controlling or setting vestibule nitrogen flow such that oxygen concentrations below the level necessary to support combustion are maintained a further benefit unexpectedly accrues, namely with reduced nitrogen flows to the vestibule, only a minimal, insignificant back diffusion of nitrogen into the work chamber occurs and hence a lower gaseous carbon source flow is required to maintain a given carbon potential. The flow of nitrogen to the vestibule has little, if any, adverse effect upon the kinetics of the carburizing reactions which readily proceed without any negative effect on process times or temperatures. Therefore, not only is the method according to the present invention effective to enable a conversion of physical characteristics of vestibule furnaces to the characteristics of pit furnaces with respect to the significantly improved consumption of natural gas already in critically short supply, but the present method is as effective in terms of carburizing reaction kinetics as are conventional vestibule furnace techniques. Thus acceptable carburization in terms of case depth, carbon concentrations, avoidance of soot and operating periods or temperatures are neither compromised nor adversely affected by the method according to the present invention. Finally, as an added benefit, endothermic carrier gas and generators therefor may be dispensed with when workpieces are carburized in accordance with the present invention.

The foregoing and other various changes in form and details may be made without departing from the spirit and scope of the present invention. Consequently, it is intended that the appended claims be interpreted as including all such changes and modifications.

What is claimed is:

1. A method of carburizing steel workpieces in the work chamber of a vestibule furnace while avoiding explosion hazards without the use of a carrier gas such as endothermic or purified exothermic gas, comprising the steps of heating said work chamber to a temperature of at least 1350° F, introducing an inert gas into the vestibule of said furnace at a flow rate of less than 50% of the carrier gas flow rate recommended for said furnace to maintain the oxygen content in the vestibule below levels at which combustion is supported while supplying a gaseous carbon source to said work chamber without a carrier gas for carburizing said workpieces without utilization of a carrier gas for said carbon source with the inert gas in said vestibule being effective to increase the residence time of said gaseous carbon source in said work chamber such that a substantial reduction in the consumption of said gaseous carbon source required for carburizing atmospheres is obtained as compared to the consumption of said gaseous carbon source required for carburizing atmospheres when said carrier gas is utilized in carburizing said workpieces.

2. A method as defined in claim 1 additionally comprising the steps of sensing the carbon potential of the atmosphere within the work chamber and controlling the supply of said gaseous carbon source to the work chamber in response to the sensed carbon potential such that a predetermined carbon potential is maintained in said atmosphere.

3. The method as defined in claim 1 wherein the gaseous carbon source comprises one or more materials selected from the group consisting of natural gas, methane, propane, butane, carbon monoxide and vaporized carbonaceous liquids.

4. The method as defined in claim 1 wherein said inert gas comprises nitrogen.

5. The method as defined in claim 1 wherein said inert gas comprises argon.

6. A method as defined in claim 1 additionally comprising the step of supplying a flow of ammonia gas independently of said gaseous carbon source to said work chamber to carbonitride said workpieces.

7. A method of carburizing steel workpieces in a vestibule furnace having an integral quench vestibule, inner and outer doors and a work chamber without a carrier gas such as endothermic or purified exothermic gas, comprising the steps of heating the work chamber to a temperature of at least 1350° F while introducing a flow of nitrogen gas into said vestibule at a flow rate of less than 50% of the carrier gas flow rate recommended for said furnace such that the oxygen content in said vestibule is maintained below a level at which combustion is supported; opening said outer door and inserting said workpieces into said vestibule; closing said outer door and detecting the pressure within said vestibule; passing said workpieces from said vestibule to said work chamber and closing said inner door after a positive pressure is detected in said vestibule; introducing a gaseous carbon source without a carrier gas therefor into said work chamber while maintaining said nitrogen flow to said vestibule thereby carburizing said workpieces with a substantially lower quantity of said gaseous carbon source than is required for carburizing atmospheres when said carrier gas is utilized in carburizing said workpieces; opening said inner door after a predetermined carburization period has elapsed; passing said carburized workpieces from said work chamber into said vestibule and closing said inner door; quenching said carburized workpieces in said vestibule for a predetermined time period whereby said workpieces are case hardened; and then removing said case hardened workpieces from said vestibule.

8. A method as defined in claim 7 wherein said step of quenching said carburized workpieces comprises immersing said carburized workpieces into an oil bath for said predetermined time period.

9. A method as defined in claim 7 wherein said step of quenching said carburized workpieces comprises elevating said carburized workpieces into the upper portion of said vestibule whereby said carburized workpieces are atmosphere quenched.

10. A method of carburizing steel workpieces as defined in claim 7 wherein said nitrogen gas in said vestibule is effective to increase the residence time of said gaseous carbon source in said work chamber and additionally comprising the steps of sensing the carbon potential of the atmosphere in said work chamber to maintain a predetermined carbon potential in said atmosphere.

11. A method of carburizing steel workpieces in the work chamber of a vestibule furnace having one or more vestibules without a carrier gas such as endothermic or purified exothermic gas comprising the steps of:

a. heating the work chamber to a temperature of at least 1350° F;
b. introducing an inert gas into each vestibule of said furnace at a flow rate of less than 50% of the carrier gas flow rate recommended for said furnace to maintain the oxygen content in each vestibule below levels at which combustion is supported;
c. placing workpieces to be carburized in said work chamber;
d. supplying a gaseous carbon source without a carrier gas therefor to said work chamber while maintaining said inert gas flow to said vestibule to carburize said workpieces;
e. sensing the carbon potential of the atmosphere in said work chamber;
f. controlling the flow of said gaseous carbon source in response to said sensed carbon potential such that said gaseous carbon source is supplied to said work chamber at the minimal flow rate necessary to maintain a predetermined carbon potential therein;
g. removing carburized workpieces from said chamber; and
h. quenching said removed carburized workpieces thereby case hardening said removed workpieces.

12. A method as defined in claim 11 wherein said furnace comprises a batch furnace having a single vestibule and said step of removing said carburized workpieces comprises passing said carburized workpieces from said work chamber to said single vestibule.

13. A method as defined in claim 11 wherein said furnace comprises a continuous furnace having separate entrance and exit vestibules and said step of removing said carburized workpieces comprises passing said carburized workpieces from said work chamber to said exit vestibule.

14. A method as defined in claim 11 wherein the step of introducing said inert gas into said vestibule is effective to increase the residence time of said gaseous carbon source in said work chamber and thereby minimize the quantity of said gaseous carbon source required to maintain said predetermined carbon potential.

* * * * *